US009390657B2

(12) United States Patent
Kim et al.

(10) Patent No.: US 9,390,657 B2
(45) Date of Patent: Jul. 12, 2016

(54) LED DRIVING APPARATUS, LED DRIVING METHOD AND DISPLAY APPARATUS USING THE SAME

(71) Applicant: SAMSUNG ELECTRONICS CO., LTD., Suwon-si (KR)

(72) Inventors: Tae-sung Kim, Suwon-si (KR); Yong-joo Lee, Incheon (KR); Jeong-il Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 329 days.

(21) Appl. No.: 13/668,848

(22) Filed: Nov. 5, 2012

(65) Prior Publication Data

US 2013/0113380 A1 May 9, 2013

(30) Foreign Application Priority Data

Nov. 3, 2011 (KR) ..... 10-2011-00114194

(51) Int. Cl.
*H05B 37/02* (2006.01)
*G09G 3/34* (2006.01)
*H05B 33/08* (2006.01)

(52) U.S. Cl.
CPC ..... *G09G 3/3406* (2013.01); *G09G 2330/04* (2013.01); *H05B 33/0815* (2013.01)

(58) Field of Classification Search
CPC ..... H05B 33/0878; H05B 33/0881; H02M 2003/1555
USPC ..... 315/121, 307
See application file for complete search history.

(56) References Cited

U.S. PATENT DOCUMENTS 8,339,063 B2 * 12/2012 Yan ..... H05B 37/02 315/209 R
8,614,553 B2 12/2013 Barth
2003/0209994 A1 * 11/2003 Kerenyi, Jr. ..... 315/219
2005/0242822 A1 * 11/2005 Klinger ..... 324/523
2008/0018267 A1 * 1/2008 Arakawa et al. ..... 315/301
2008/0238344 A1 * 10/2008 Isobe et al. ..... 315/312
2009/0302774 A1 * 12/2009 Mednik et al. ..... 315/209 R
2011/0204800 A1 * 8/2011 Lin ..... H05B 33/0827 315/185 R
2011/0210681 A1 * 9/2011 Barth ..... 315/276
2011/0285561 A1 * 11/2011 Ko et al. ..... 341/110

(Continued)

FOREIGN PATENT DOCUMENTS

CN 102014536 A 4/2011
CN 102204407 A 9/2011

OTHER PUBLICATIONS

LT3754 LED Driver, Linear Technology Corporation, 2009.*

(Continued)

*Primary Examiner* — Don Le
(74) *Attorney, Agent, or Firm* — Sughrue Mion, PLLC

(57) ABSTRACT

A display apparatus is provided. The display apparatus includes a display panel configured to display an image, an LED module configured to provide backlight to the display panel, an LED driving unit configured to apply a driving voltage to the LED module using an external power, an exterior unit configured to support the LED driving unit and the LED module and include a ground terminal provided separately from the external power, and an LED driving control unit which causes an operation of the LED driving unit to be stopped based on a current flowing in from the ground terminal.

16 Claims, 7 Drawing Sheets

(56) References Cited

U.S. PATENT DOCUMENTS

| | | | | |
|---|---|---|---|---|
| 2012/0074868 | A1* | 3/2012 | Tseng | H05B 33/0815 315/294 |
| 2012/0181931 | A1* | 7/2012 | Katsura | B60Q 11/005 315/82 |
| 2015/0241891 | A1* | 8/2015 | Lee | G05F 1/62 315/127 |

OTHER PUBLICATIONS

Linear Technology, LT3754, '16-Channel x 50ma LED Driver', 2009.*

Extended European Search Report, dated Jul. 4, 2012, issued by the European Patent office in corresponding European Application No. 12162274.0.

PowTech, "PT4207—Universal High Brightness LED Driver," Jan. 1, 2011, XP002678162, pp. 1-6.

Supertex Inc., "HV9861A—LED Driver with Average-Mode, Constant Current Control," Oct. 27, 2011, XP002678164, pp. 1-10.

Linear Technology, "LT3754—16-Channel x 50mA LED Driver," Jan. 1, 2009, XP002678163, pp. 1-30.

Communication from the State Intellectual Property Office of P.R. China dated Nov. 4, 2015 in a counterpart Chinese application No. 201210430810.1.

* cited by examiner

LED DRIVING APPARATUS, LED DRIVING METHOD AND DISPLAY APPARATUS USING THE SAME

CROSS-REFERENCE TO RELATED APPLICATION

This application claims priority from Korean Patent Application No. 10-2011-0114194, filed on Nov. 3, 2011, in the Korean Intellectual Property Office, the disclosure of which is incorporated herein by reference in its entirety.

BACKGROUND

1. Field

Apparatuses and methods consistent with exemplary embodiments relate to a light emitting diode (LED) driving apparatus, an LED driving method, and a display apparatus using the same, and more particularly, to a LED driving apparatus capable of providing backlight to a non-self-emissive display, a LED driving method, and a display apparatus using the same.

2. Description of the Related Art

LEDs have been widely used in various fields due to high performance and a long life span and are used as backlights of display apparatuses.

When a LED module is used as a backlight of a display apparatus, the LED module is disposed outside a display panel and a LED driving circuit which drives the LED module is disposed inside the display panel, so that the LED module and the LED driving circuit are mainly connected through a wire.

However, in this case, the wire is pressed by a panel structure in an assembly process of the display panel so that an insulating layer is cracked or a part of a printed circuit board (PCB) pattern in the LED module is damaged. Therefore, the LED module is likely to be short-circuited with a panel chassis.

When the LED module is short-circuited with the panel chassis, in a buck type LED driving circuit in which a LED module is driven by applying a peak current control method, a high external power is applied to the LED module to flow high current through the LED module, so that the LED module is damaged.

Therefore, when the LED module is short-circuited with the panel chassis, there is a need for a method for preventing the LED module from being damaged by sensing the short circuit and blocking an external power applied to the LED module.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide an LED driving apparatus which determines short circuit between an LED module and an armoring unit and blocks an external power applied to the LED module, an LED driving method and a display apparatus using the same.

According to an aspect of an exemplary embodiment, there is provided a display apparatus. The display apparatus may include: a display panel configured to display an image; an LED module configured to provide backlight to the display panel; an LED driving unit configured to apply a driving voltage to the LED module using an external power; an exterior unit configured to support the LED driving unit and the LED module and include a ground terminal provided separately from the external power; and an LED driving control unit configured to cause an operation of the LED driving unit to be stopped based on a current flowing in from the ground terminal.

The LED driving control unit may sense an intensity of a current flowing in the LED module and transmit a sensing result to the LED driving unit; and may sense an intensity of the current flowing in from the ground terminal and cause the external power applied to the LED driving unit to be blocked, thereby causing the operation of the LED driving unit to be stopped when the intensity of the current flowing in from the ground terminal is equal to or larger than a preset first reference value.

The LED driving unit may apply the driving voltage to the LED module while causing an inductor to be excited using the current flowing in from the external power when the intensity of the current flowing in the LED module is smaller than a preset second reference value and apply the driving voltage to the LED module using a current induced by the excited inductor when the intensity of the current flowing in the LED module is equal to or larger than the second reference value. The first reference value may be larger than the second reference value.

The LED driving unit may include a first capacitor connected in parallel to the external power, a second capacitor connected in parallel to the LED module, a first diode of which a cathode is commonly connected to one terminal of the first capacitor, one terminal of the second capacitor, and an anode of the LED module, the inductor of which one terminal is connected to an anode of the first diode and the other terminal is commonly connected to the other terminal of the second capacitor and a cathode of the LED module, and a transistor of which a drain is commonly connected to the one terminal of the inductor and the anode of the first diode and a source is connected to the ground terminal.

The LED driving control unit may sense the intensity of the current flowing in the LED module and the intensity of the current flowing in from the ground terminal using a resistor of which one terminal is connected to the ground terminal and the other terminal is connected to a ground terminal of the external power.

The LED driving control unit may further include a first comparator configured to compare the intensity of the current flowing in from the ground terminal with the first reference value.

The LED driving control unit may further include a second comparator configured to compare the intensity of the current flowing in from the ground terminal with a preset third reference value and an OR gate configured to perform a logic OR operation on a comparison result of the first comparator and a comparison result of the second comparator and output a logic OR operation result. The first reference value may be larger than the third reference value.

The LED driving unit may further include an oscillator configured to generate a clock signal for periodically driving the transistor, a third comparator configured to compare the intensity of the current flowing in the LED module with the second reference value, an RS flip flop configured to receive a comparison result of the third comparator as a reset signal and an output signal of the oscillator as a set signal, and an AND gate configured to perform a logic AND operation on a dimming signal and an output signal of the RS flip flop and apply a logic AND operation result to a gate of the transistor.

According to another aspect of an exemplary embodiment, there is provided an LED driving apparatus which controls an LED module. The LED driving apparatus may include: an LED driving unit configured to apply a driving voltage to the LED module using an external power; an exterior unit configured to support the LED driving unit and the LED module and include a ground terminal provided separately from the external power; and an LED driving control unit configured to cause an operation of the LED driving unit to be stopped based on a current flowing in from the ground terminal.

The LED driving control unit may sense an intensity of a current flowing in the LED module and transmit a sensing result to the LED driving unit; and sense an intensity of the current flowing in from the ground terminal and cause the external power applied to the LED driving unit to be blocked, thereby causing the operation of the LED driving unit to be stopped when the intensity of the current is equal to or larger than a preset first reference value.

The LED driving unit may apply the driving voltage to the LED module while causing an inductor to be excited using a current flowing in from the external power source when the intensity of the current flowing in the LED module is smaller than a preset second reference value and apply the driving voltage to the LED module using a current induced by the excited inductor when the intensity of the current flowing in the LED module is equal to or larger than the second reference value. The first reference value may be larger than the second reference value.

The LED driving unit may include a first capacitor connected in parallel to the external power, a second capacitor connected in parallel to the LED module, a first diode of which an anode is commonly connected to one terminal of the first capacitor, one terminal of the second capacitor, and an anode of the LED module, the inductor of which one terminal is connected to an anode of the first diode and the other terminal is commonly connected to the other terminal of the second capacitor and a cathode of the LED module, and a transistor of which a drain is commonly connected to the one terminal of the inductor and the anode of the first diode and a source is connected to the ground terminal.

The LED driving control unit may sense the intensity of the current flowing in the LED module and the intensity of the current flowing in from the ground terminal using a resistor of which one terminal is connected to the ground terminal and the other terminal is connected to a ground terminal of the external power.

The LED driving control unit may further include a first comparator configured to compare the intensity of the current flowing in from the ground terminal with the first reference value.

The LED driving control unit may further include a second comparator configured to compare the intensity of the current flowing in from the ground terminal with a preset third reference value and an OR gate configured to perform a logic OR operation on a comparison result of the first comparator and a comparison result of the second comparator and output a logic OR operation result. The first reference value may be larger than the third reference value.

The LED driving unit may further include an oscillator configured to generate a clock signal for periodically driving the transistor, a third comparator configured to compare the intensity of the current flowing in the LED module with the second reference value, an RS flip flop configured to receive a comparison result of the third comparator as a reset signal and an output signal of the oscillator as a set signal, and an AND gate configured to perform a logic AND operation on a dimming signal and an output signal of the RS flip flop and apply a logic AND operation result to a gate of the transistor.

According to another aspect of an exemplary embodiment, there is provided an LED driving method of controlling an LED module. The LED driving method may include applying a driving voltage to the LED module using an external power; sensing an intensity of a current flowing in from a ground terminal provided separately from the external power; and causing the driving voltage applied to the LED module to be blocked when the intensity of the current flowing in from the external terminal is equal to or is larger than a preset first reference value.

The applying the driving voltage to the LED module may include applying the driving voltage to the LED module while causing an inductor to be excited using a current flowing in from the external power when an intensity of a current flowing in the LED module is smaller than a preset second reference value; and applying the driving voltage to the LED module using a current induced by the excited inductor when the intensity of the current flowing in the LED module is equal to or larger than the second reference value. The first reference value may be larger than the second reference value.

According to the above-described various exemplary embodiments, when the LED module is short-circuited with the exterior unit, it is possible to cause an external power applied to the LED driving unit to be blocked, thereby causing an operation of the LED module to be stopped. Thereby, even when the LED module is short-circuited with the exterior unit, it is possible to prevent the high external voltage from being applied to the LED module and prevent the LED module from being damaged.

Additional aspects and advantages of the exemplary embodiments will be set forth in the detailed description, will be obvious from the detailed description, or may be learned by practicing the exemplary embodiments.

BRIEF DESCRIPTION OF THE DRAWING FIGURES

The above and/or other aspects will be more apparent by describing in detail exemplary embodiments, with reference to the accompanying drawings, in which.

DETAILED DESCRIPTION OF THE EXEMPLARY EMBODIMENTS

Figure 1:
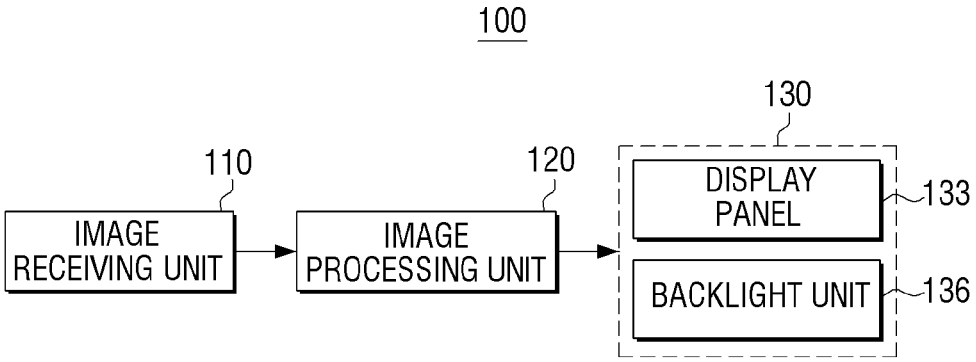
FIG. 1 is a block diagram illustrating a configuration of a display apparatus according to an exemplary embodiment.

Hereinafter, exemplary embodiments will be described in more detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

FIG. 1 is a block diagram illustrating a configuration of a display apparatus according to an exemplary embodiment. As shown in FIG. 1, a display apparatus 100 includes an image receiving unit 110, an image processing unit 120, and a display unit 130.

The image receiving unit 110 receives an image signal and image data by cable or wirelessly from a broadcasting station, a satellite, an external input apparatus, or the like. For example, the image receiving unit 110 may be a tuner configured to receive a broadcasting signal or an audio/video (A/V) interface configured to receive an image from an external image apparatus.

The image processing unit 120 performs signal processing on an image output from the image receiving unit 110 such as video decoding, video scaling, frame rate conversion (FRC), luminance adjustment, or color adjustment.

The display unit 130 displays an input image on a screen. As shown in FIG. 1, the display unit 130 includes a display panel 133 and a back light unit 136.

The display panel 133 displays an image signal-processed in the image processing unit 120. Here, the display panel 133 may be a liquid crystal display (LCD) panel, but is not limited thereto. In addition, the display panel 133 may be any panel using backlight.

The backlight unit 136 radiates backlight to the display panel 133. Since the display panel 133 is not self-emissive, the backlight unit 136 radiates white light to the display panel 133 as the backlight.

The backlight unit 136 includes a plurality of light sources. Here, LEDs may be used as the plurality of light sources. That is, the plurality of light sources may be an LED module in which at least one LED is connected to a printed circuit board (PCB).

In addition, the backlight unit 136 may be an edge type backlight. Specifically, the backlight unit 136 may be an edge type unit in which light sources are arranged in an edge region of the display panel 136. Alternatively, the backlight unit 136 is not limited to the edge type backlight. The backlight unit 136 may be a direct type in which light sources are evenly arranged on an entire rear surface of the display panel 133.

Figure 2:
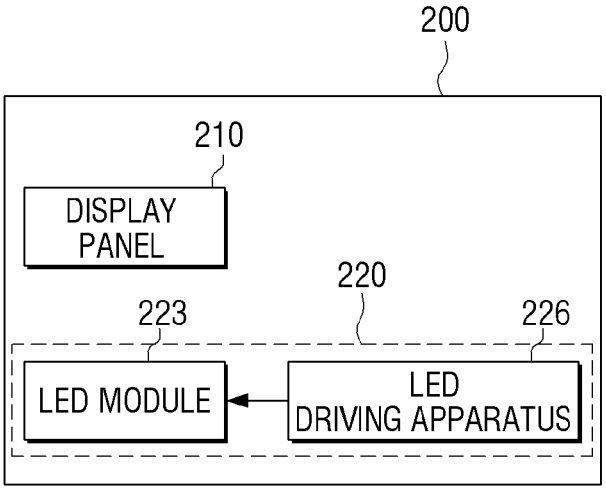
FIG. 2 is a block diagram illustrating a specific configuration of a display unit according to an exemplary embodiment.

FIG. 2 is a block diagram illustrating a detailed configuration of a display unit according to an exemplary embodiment. As shown in FIG. 2, a display unit 200 includes a display panel 210 and a backlight unit 220. The display panel 210 and the backlight unit 220 of FIG. 2 have the same function as the display panel 133 and the backlight unit 136 of FIG. 1 and thus overlapping description will be omitted.

The backlight unit 220 includes an LED module 223, an LED driving apparatus 226, and an exterior unit (not shown).

The LED module 223 radiates backlight to the display panel 210. Specifically, the LED module 223 may include at least one LED connected on a PCB and radiate the backlight to the display panel 210 according to a driving voltage applied from the LED driving apparatus 226. Here, a brightness of the LED module 223 may depend on an average value of a current flowing in the LED module 223.

The LED driving apparatus 226 supplies power to the LED module 223.

Specifically, the LED driving apparatus 226 may supply an external power or an energy stored in the LED driving apparatus 226 to the LED module 223 based on a dimming signal for driving the LED module 223 and the current flowing in the LED module 223. Here, the dimming signal may be a signal for luminance adjustment and color temperature adjustment of an LED or a signal for temperature compensation using a duty ratio of a pulse width modulation (PWM) signal.

More specifically, the LED driving apparatus 226 stores an energy therein using the external power and applies a driving voltage to the LED module in a state that the mining signal is ON. Then, the LED driving apparatus 226 may cause the external power supplied to the LED module 223 to be blocked and supply the driving voltage to the LED module 223 based on the energy stored in the LED driving apparatus 226 when the current flowing in the LED module 223 reaches a preset peak value in the state that the dimming signal is ON.

As described above, the LED driving apparatus 226 according to the exemplary embodiment may include a buck type LED driving circuit and control an LED output current according a peak current control method.

Here, the buck type LED driving circuit may be a driving circuit which is implemented with a transistor, an inductor, a capacitor, a diode and the like, and converts an external driving voltage into a direct current (DC) voltage and provides the converted DC voltage to an LED module connected in parallel thereto.

Specifically, the buck type LED driving circuit converts the external power into a driving voltage of the LED module and provides the converted driving voltage to the LED module when the transistor turns on in the state that the dimming signal is ON. Then, the buck type LED driving circuit causes the transistor to turn off when a current flowing in the transistor reaches the preset peak value according to the peak current control method and provides energy stored in the inductor and capacitor during a turn-on time of the transistor to the LED module.

By the above-described manner, the buck type LED driving circuit controls to cause a constant current to flow in the LED module.

The exterior unit (not shown) supports the LED module 223 and the LED driving apparatus 226. That is, the LED module 223 and the LED driving apparatus 226 may be attached to the exterior unit to radiate backlight to the display panel 210. The exterior unit configured to perform the function may be a panel chassis.

Meanwhile, the LED module and the LED driving apparatus are typically connected by wired means or the like in that the LED module is disposed in an edge region of a display panel and the LED driving apparatus is provided inside the display panel in the display apparatus. Accordingly, in a display panel assembly process, the wire is pressed by a panel structure and an insulating layer is damaged or a part of PCB patterns in the LED module is damaged. Therefore, a current path may be formed through a panel chassis ground due to short circuit with the panel chassis.

However, when the current path is formed through the panel chassis ground, if the LED module is controlled by the peak current control method, it is impossible to supply a constant current to the LED module and a high driving voltage is applied to the LED module to cause damage to the LED module.

Therefore, according to the exemplary embodiment, the LED driving apparatus senses a current flowing through the panel ground chassis and causes an operation of the LED driving apparatus to be stopped when an intensity of the sensed current is equal to or larger than a preset reference value. Hereafter, the LED driving apparatus according to the exemplary embodiment will be described in detail with reference to FIG. 3.

Figure 3:
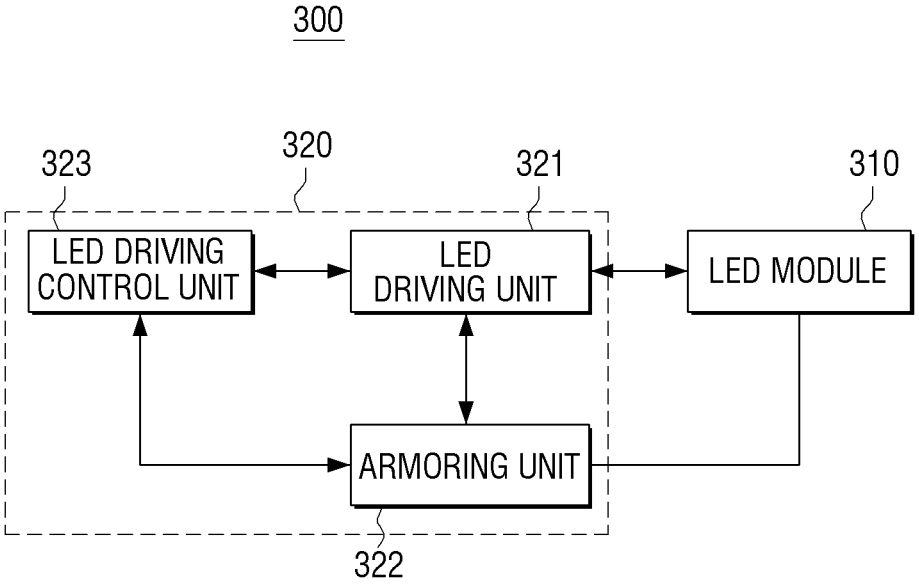
FIG. 3 is a block diagram illustrating a detailed configuration of an LED driving apparatus according to an exemplary embodiment.

FIG. 3 is a block diagram illustrating a detailed configuration of an LED driving apparatus according to an exemplary embodiment. As shown in FIG. 3, an LED driving apparatus 320 includes an LED driving unit 321, an exterior unit 322, and an LED driving control unit 323. For clarity, an LED module 310 constituting a backlight 300 is illustrated together with the LED driving apparatus 320.

The LED driving unit 321 applies a driving voltage to the LED module 310 using an external power.

Specifically, the LED driving unit 321 may apply the driving voltage to the LED module 310 while causing an inductor to be excited using a current flowing in from the external power when an intensity of a current flowing in the LED module 310 is smaller than a preset second reference value and apply the driving voltage to the LED module 310 using a current induced by the excited inductor when the intensity of the current flowing in the LED module 310 is equal to or larger than a preset second reference value.

The LED driving unit 321 configured to perform the function may be implemented with a buck type LED driving circuit configured to drive the LED module 310 according to a peak current control method. Therefore, the second reference value may be twice an average value of the current flowing in the LED module 310.

The exterior unit 322 supports the LED module 310 and the LED driving unit 321 and includes a ground terminal provided separately from the external power. That is, the exterior unit 322 may allow the LED module 310 and the LED driving unit 321 to be mounted and allows a current generated in the LED driving unit 321 to be grounded.

The exterior unit 322 having the function may be a panel chassis configured of a conductive material. Alternatively, the exterior unit 322 may include a panel chassis ground provided separately from the external power.

The LED driving control unit 323 causes an operation of the LED driving unit 321 to be stopped based on the current flowing in from the ground terminal.

Specifically, the LED driving control unit 323 may sense an intensity of a current flowing in the LED module 310 and transmit the sensing result to the LED driving unit 321 and the LED driving control unit 323 may sense an intensity of the current flowing in from the ground terminal, causes the external power applied to the LED driving unit 321 to be blocked, and causes the operation of the LED driving unit 321 to be stopped when the sensed intensity of the current is equal to or larger than a preset first reference value. Here, the first reference value may be larger than the second reference value.

That is, the LED driving control unit 323 may sense a current flowing from the LED module 310 to the exterior unit 322 using the current flowing in from the ground terminal when the LED module 310 is short-circuited with the exterior unit 322 due to damage of an insulating layer in a wire which connects the LED module 310 to the LED driving unit 321 or damage of a part of PCB patterns in the LED module 310.

The LED driving control unit 323 may prevent a high driving voltage from being applied to the LED module 310 in that when the intensity of the current flowing from the LED module 310 to the exterior unit 322 is equal to or larger than the preset first reference value, the LED driving control unit 323 causes the operation of the LED driving unit 321 to be stopped.

Figure 4:
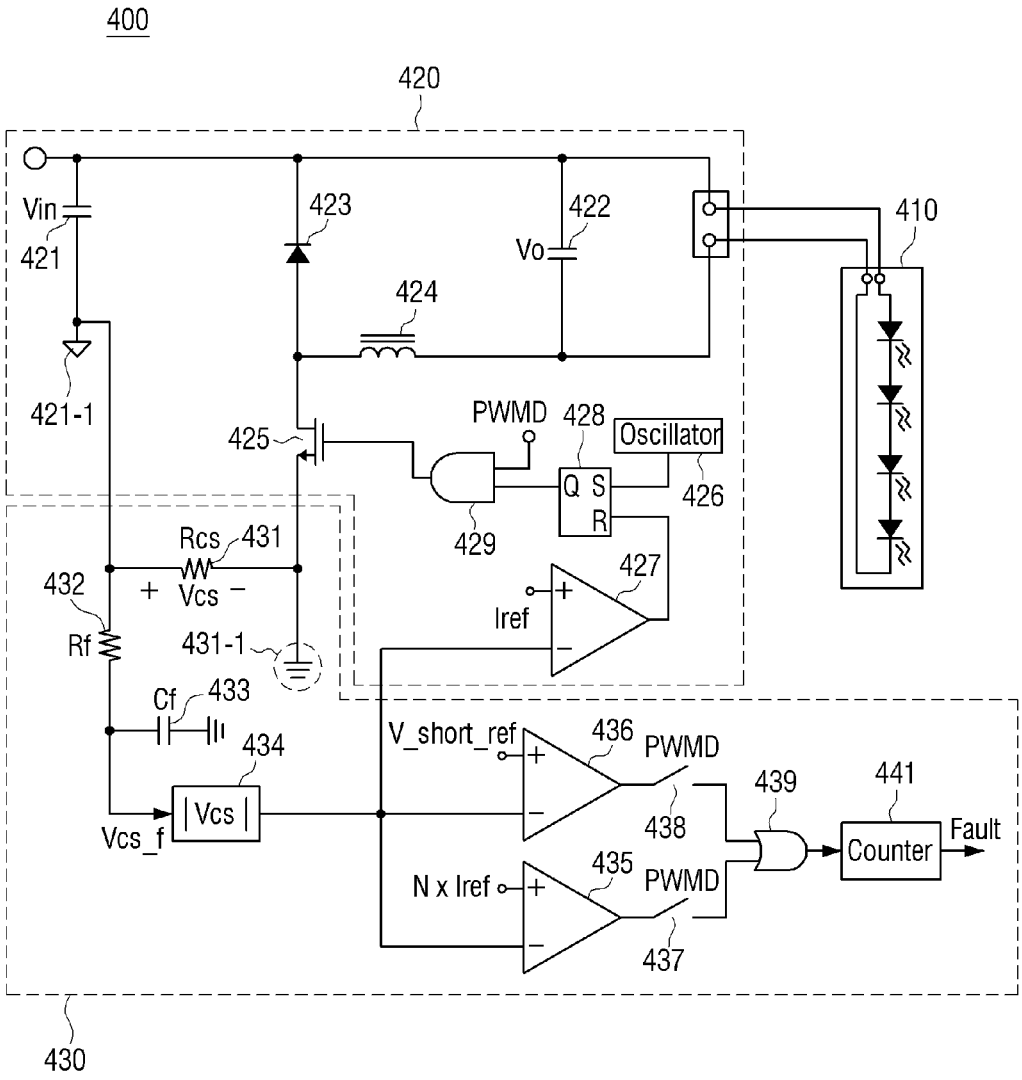
FIG. 4 is a circuit diagram illustrating a detailed configuration of an LED driving apparatus according to an exemplary embodiment.

FIG. 4 is a circuit diagram illustrating a detailed configuration of an LED driving apparatus according to an exemplary embodiment. That is, FIG. 4 illustrates a detailed circuit diagram of each configuration of the LED driving apparatus as shown in FIG. 3. For clarity, in FIG. 4, an LED module 410 constituting a backlight 400 is added and an exterior unit is omitted.

The LED driving unit 420 includes a first capacitor 421, a second capacitor 422, a first diode 423, an inductor 424, a transistor 425, an oscillator 426, a third comparator 427, an RS flip flop 428, and an AND gate 429.

The first capacitor 421 is connected in parallel to an external power $V_{in}$. Thus, the first capacitor may store the external power Vin and apply a driving voltage to the LED module 410. However, it is only an example of the first capacitor 421 and the first capacitor 421 may be replaced with the external power Vin.

Specifically, one terminal of the first capacitor 421 is commonly connected to the cathode of the first diode, one terminal of the second capacitor 422, and an anode of the LED module 410 and the other terminal of the first capacitor 421 is connected to a ground terminal 421-1 of the external power Vin.

The second capacitor 422 is connected in parallel to the LED module 410. Thus, the second capacitor 422 may apply an output voltage Vo to the LED module 410.

Specifically, one terminal of the second capacitor 422 is commonly connected to a cathode of the first diode 423, the one terminal of the first capacitor 421, the anode of the LED module 410 and the other terminal of the second capacitor 422 is commonly connected to a cathode of the LED module 410 and the other terminal of the inductor 424.

A cathode of the first diode is commonly connected to the one terminal of the first capacitor, the other terminal of the second capacitor, and the anode of the LED module 410. The anode of the first diode 423 is commonly connected to one terminal of the inductor and a drain of the transistor 425.

The one terminal of the inductor 424 is connected to the anode of the first diode 423 and the other terminal of the inductor 424 is commonly connected to the other terminal of the second capacitor 422 and the cathode of the LED module 410. Specifically, the one terminal of the inductor 424 is commonly connected to the anode of the first diode 423 and the drain of the transistor 425.

The drain of the transistor 425 is commonly connected to the one terminal of the inductor 424 and the anode of the first diode 423, a source of the transistor is connected to a ground terminal 431-1. In addition, a gate of the transistor 425 is connected to an output of the AND gate.

Here, the ground terminal 431-1 may be connected to a ground terminal of the exterior unit (322 in FIG. 3) having a reference voltage different from the ground terminal 421-1 of the external power.

The oscillator 426 generates a clock signal for periodically driving the transistor 425. Specifically, the oscillator 426 provides the clock signal having a constant frequency as a set signal of the RS flip flop 428 to allow the transistor 425 to turn on periodically.

The third comparator 427 compares an intensity of a current flowing in the LED module 410 with a preset second reference value $I_{ref}$. Here, the second reference value $I_{ref}$ may be set to a voltage value corresponding to a value which is twice an average current flowing in the LED module 410. That is, the second reference value $I_{ref}$ may be set to a value, that is, (an average value of a current which flows in the LED module 410 so as to obtain brightness by a user's desire)× 2×(a resistance of a first resistor $R_{cs}$).

Specifically, the third comparator 427 may receive the intensity of the current flowing in the LED module 410 in an inverting terminal thereof and receive the preset second reference value $I_{ref}$ in a non-inverting terminal thereof.

The RS flip flop 428 receives a comparison result of the third comparator 427 as a reset signal and the output signal of the oscillator 426 as a set signal. The RS flip flop 428 outputs an output signal to the AND gate 429.

The AND gate 429 performs a logic AND operation on a dimming signal and the output signal of the RS flip flop 428 and outputs a logic AND operation result to the gate of the transistor 425. Here, the dimming signal may be signal having a constant frequency to drive the LED module 410.

The LED driving control unit 430 may sense the intensity of the current flowing in the LED module 410 and transmit the sensing result to the LED driving unit 420. The LED driving control unit 430 may sense an intensity of a current flowing in from the ground terminal 431-1 and cause the external power applied to LED driving unit 420 to be blocked when the sensed intensity of the current is equal to or larger than a preset first reference value.

Here, the LED driving unit 430 may sense the intensity of the current flowing in the LED module 410 and the intensity of the current flowing in from the ground terminal 421-1 using the first resistor 431 (or $R_{cs}$) of which one terminal is connected to the ground terminal 431-1 and the other terminal is connected to the ground terminal 421-1 of the external power.

The LED driving control unit 430 having the above-described function may include the first resistor 431, a second resistor 432, a third capacitor 433, an inverting unit 434, a first comparator 435, a second comparator 436, a first switch 437, a second switch 438, an OR gate 439, and a counter 441.

In the first resistor 431, the one terminal may be commonly connected to the source of the transistor 425 and the ground terminal 431-1 and the other terminal may be commonly connected to the ground terminal 421-1 of the external power and the second resistor 432. Here, the external power and the other terminal of the first capacitor 421 are commonly connected to the ground terminal 421-1 in that the external power is connected in parallel to the first capacitor 421.

In the second resistor 432, one terminal may be commonly connected to the first resistor 431 and the ground terminal 421-1 of the external power and the other terminal may be commonly connected to one terminal of the third capacitor 433 and the inverting unit 434.

In the third capacitor 433, the one terminal is commonly connected to the other terminal of the second resistor 432 and the inverting unit 434 and the other terminal is grounded.

Here, the second resistor 432 and the third capacitor 433 may function as a filter to remove noise of a voltage applied to the first resistor 431 by a current flowing in from the ground terminal 431-1.

The inverting unit 434 performs a function to invert a voltage $V_{cs}$ applied to the first resistor 431. That is, in that the voltage $V_{cs}$ applied to the first resistor 431 has a negative value on the basis of the ground terminal 431-1, the inverting unit 434 may invert the voltage $V_{cs}$ applied to the first voltage 431 into a positive value. The inverting unit 434 having the above-described function may be implemented with various circuits previously known.

The first comparator 435 receives an output of the inverting unit 434 in an inverting terminal thereof and a preset first reference value $N \times I_{ref}$ (N is a real number larger than 1) in a non-inverting terminal thereof. Thus, the first comparator 435 may compare the intensity of the current flowing in from the ground terminal 431-1 with the first reference value $N \times I_{ref}$.

Here, the first reference value $N \times I_{ref}$ may be larger than the second reference value $I_{ref}$. That is, the first reference value $N \times I_{ref}$ may be set to a value, that is, (an average of a current which flows in the LED module to obtain brightness of a user's desire)×2×N×(a resistance of the first resistor $R_{cs}$).

The second comparator 436 receives the output of the inverting unit 434 in an inverting terminal thereof and a preset third reference value V_short_ref in a non-inverting terminal thereof. Thus, the second comparator 436 may compare the intensity of the current flowing in from the ground terminal 431-1 with the preset third reference value V_short_ref.

Here, the third reference value V_short_ref may be a value smaller than the first reference value $N \times I_{ref}$ and the second reference value $I_{ref}$. The third reference value V_short_ref is a value for sensing whether or not a current is flowing in the LED module 410 when the LED module 410 is short-circuited with an exterior unit (322 in FIG. 3) in a state that the dimming signal is OFF. For example, the second reference value $I_{ref}$ may be 0 (zero) or larger than 0.

The first switch 437 performs a switching operation according to the dimming signal PWMD. Specifically, the first switch 437 may turn on when the dimming signal is ON while the first switch 437 may turn off when the dimming signal is OFF.

The second switch 438 performs a switching operation according to the dimming signal PWMD. Specifically, the second switch 438 may turn off when the dimming signal is ON while the second switch 438 may turn on when the dimming signal is OFF.

The OR gate 439 performs a logic OR operation on a comparison result of the first comparator 435 and a comparison result of the second comparator 436 and outputs a logic OR operation result. That is, when an output signal of a high state is output from one of the comparator 435 and the second comparator 436, the OR gate 439 may output an output signal of a high state.

The counter 441 performs a filtering operation on an output of the OR gate 439 to remove noise. Although the above-described exemplary embodiment has illustrated that a counter is used to prevent malfunction due to noise, an RC filter may be used to remove the noise.

In addition, the above-described exemplary embodiment has illustrated that the LED driving control unit 430 includes the first resistor 431 (or $R_{cs}$) the second resistor 432 (or $R_f$), the third capacitor 433 (or $C_f$), the inverting unit 434, the first comparator 435, the second comparator 436, the first switch 437, the second switch 438, the OR gate 439, and the counter 441, but it is only an example. That is, the LED driving control unit 430 may be implemented with only the first resistor 431 (or $R_{cs}$) and the first comparator 435 which are requisite components which sense a current flowing in from the ground terminal 431-1 in a state that the dimming signal is ON and cause the external power applied to the LED driving unit 420 to be blocked.

Hereinafter, a specific operation of the LED driving apparatus according to an exemplary embodiment will be described with reference to the accompany FIGS. 5A and 5B.

Figure 5A:
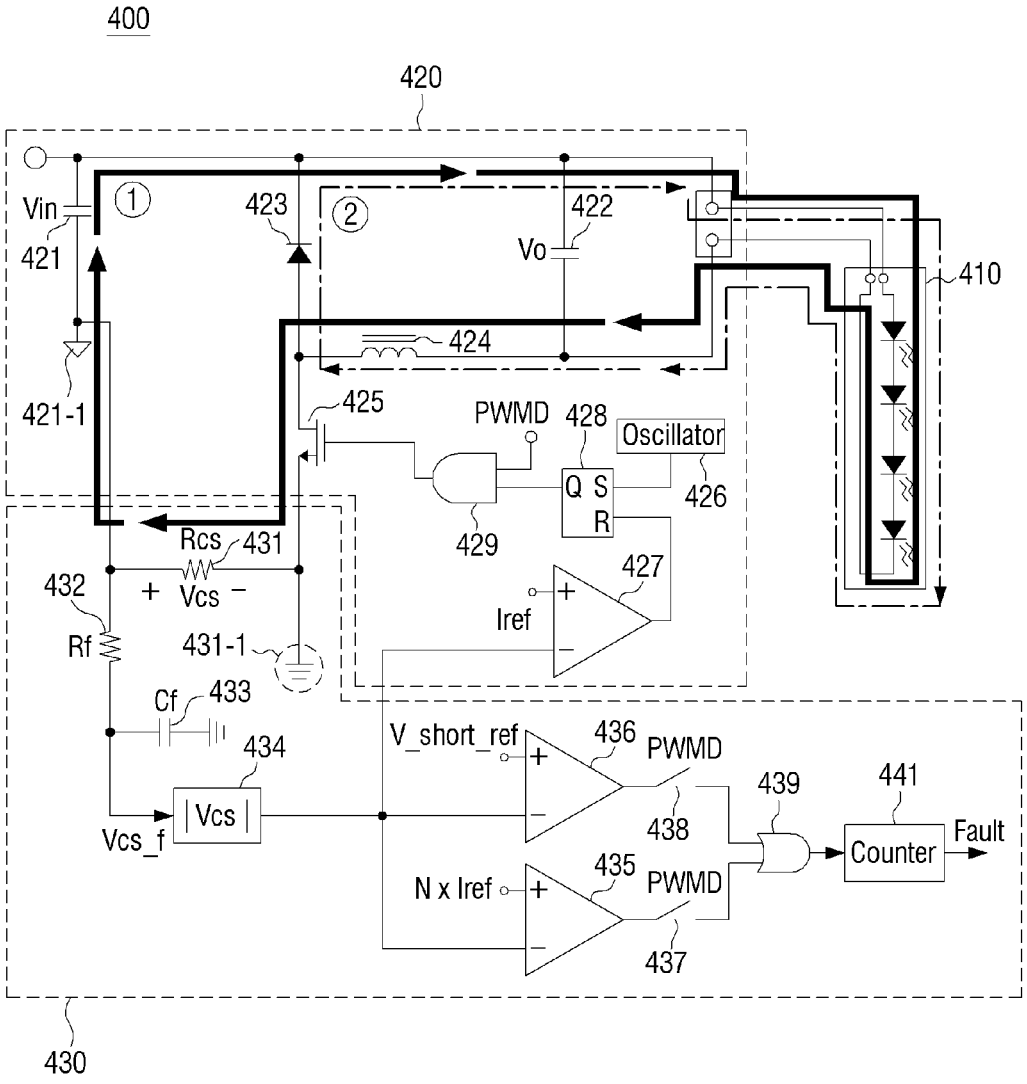
FIGS. 5A and 5B are circuit diagrams illustrating an operation of an LED driving apparatus according to an exemplary embodiment.
Figure 5B:
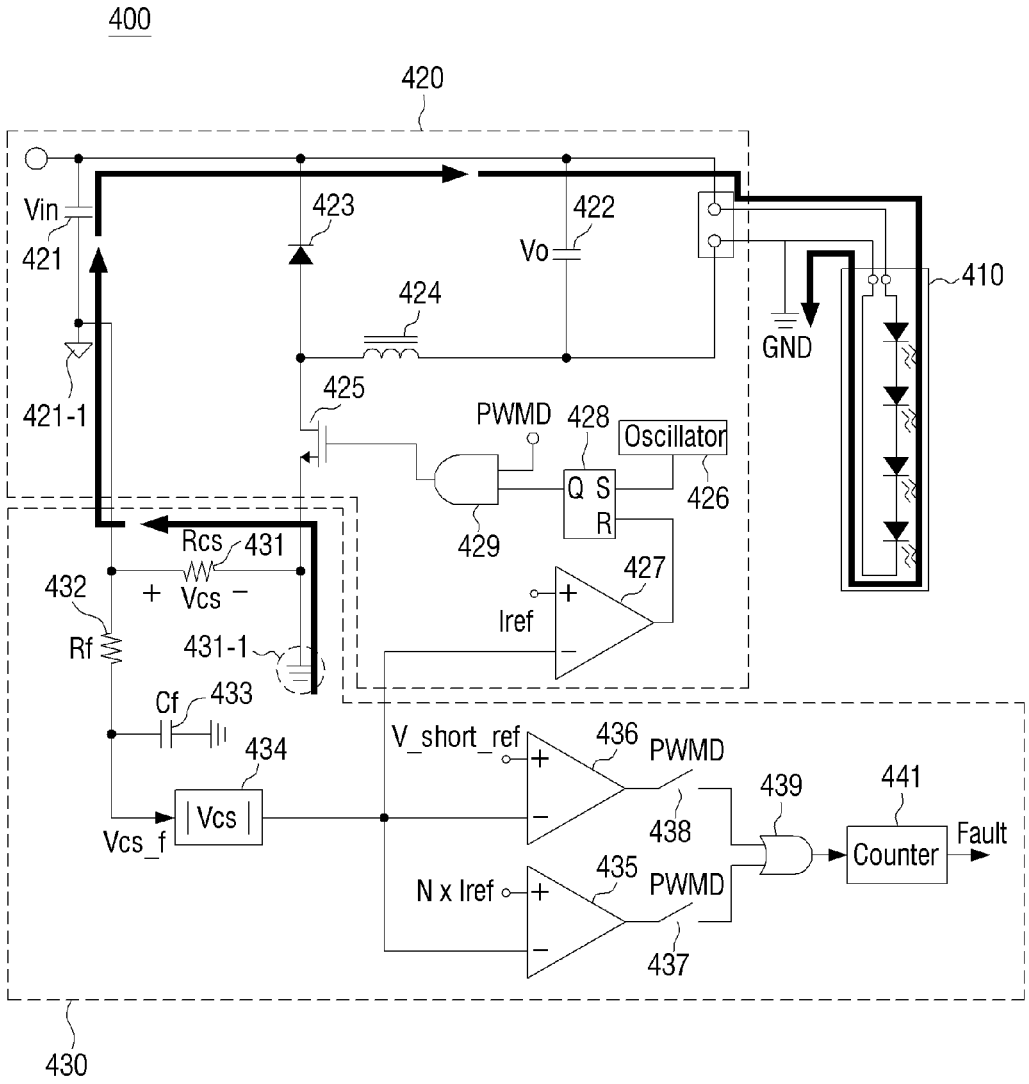

Referring to FIGS. 5A and 5B, FIGS. 5A and 5B are circuit diagrams illustrating an operation of an LED driving apparatus according to an exemplary embodiment. Specifically, FIG. 5A illustrates the case where the LED module 410 is not short-circuited with an exterior unit (not shown) and FIG. 5B illustrates the case where the LED module 410 is short-circuited with the exterior unit (not shown).

First, referring to FIG. 5A, when the transistor 425 is turned on by a clock signal of the oscillator 426 in a state that the dimming signal is ON, a current (hereinafter, referred to as LED output current) flows in a ① arrow direction in the LED module 410 by the external power Vin stored in the first capacitor 421. Then, the inductor 424 is excited by the external power Vin.

A variation amount in the LED output current to a time (that is, a slope) becomes $(Vin-V_o)/L$ (L is an inductance of the inductor 424) based on the external power Vin and the output voltage $V_o$ of the second capacitor 423. That is, the LED output current has a slope of $(Vin-V_o)/L$ and is gradually increased.

Hereafter, when the LED output current reaches the second reference value $I_{ref}$, the LED driving unit 420 causes the transistor 425 to turn off.

Specifically, the first resistor 431 senses a voltage applied by the LED output current and the second resistor 432 and the third capacitor 433 removes noise included in the sensed voltage. Then, the inverting unit 434 inverts the sensed voltage and output an inverted result to the third comparator 427.

The third comparator 427 determines whether or not the LED output current reaches the second reference value $I_{ref}$ and outputs a signal of a high state to the RS flip flop 428 as a reset input when the LED output current reaches the second reference value $I_{ref}$. Specifically, the third comparator 427 compares a voltage value applied to the first resistor 431 by the LED output current with the second reference value $I_{ref}$ and outputs the signal of a high state when the voltage value applied to the first resistor 431 reaches the second reference value $I_{ref}$.

Here, the second reference value $I_{ref}$ may be set to a value, that is, (an average value of a current which flows in the LED module 410 to obtain brightness according to a user's desire)×2×(a resistance of the first resistor $R_{cs}$).

Thus, the RS flip flop 428 outputs a signal of a low state to the AND gate 429 and the AND gate 429 receives the signal of a low state in a state that the dimming signal PWMD is ON and outputs a signal of a low state to the gate of the transistor 425. Therefore, the transistor 425 turns off when the LED output current reaches the second reference value $I_{ref}$.

After the transistor 425 turns off, the LED driving unit 420 applies a driving voltage to the LED module 410 using a current induced by the excited inductor 424 during a turn-on time of the transistor 425. Thus, a current flows in a ② arrow direction in the LED module.

In conclusion, when the LED module 410 is not short-circuited with the exterior unit (not shown), the above-described process is iteratively performed to flow a constant current in the LED module 410.

Meanwhile, when the LED module 410 is short-circuited with the exterior unit (not shown), the LED driving apparatus according to the exemplary embodiment senses a current flowing to the exterior unit (not shown) from the LED module 410 and causes an operation of the LED driving unit 420 to be stopped when the sensed current is equal to or larger than the first reference value $N\times I_{ref}$. Hereinafter, the operation will be described in more detail with reference to FIG. 5B.

FIG. 5B illustrates an example of the case where an insulating layer of a wire which connects the LED module 410 and the LED driving unit 420 is damaged so that the LED module 410 is short-circuited with the exterior unit (not shown).

As shown in FIG. 5B, a wire which connects the LED module 410 and the LED driving unit 420 is short-circuited with the exterior unit (not shown), a current output from the LED module 410 flows to a ground terminal provided in the exterior unit (not shown) through the wire.

However, since the LED driving control unit 430 according to the exemplary embodiment is connected to the ground terminal of the exterior unit (not shown), the LED output current flowing to the ground terminal of the exterior unit through the wire is flowing in to the LED driving control unit 430 as in the arrow direction.

Meanwhile, in a state that the dimming signal is ON, the LED driving control unit 430 senses the intensity of the current flowing in through the ground terminal 431-1 and causes the external power applied to the LED driving unit 420 to be blocked and causes an operation of the LED driving unit 420 to be stopped when the sensed intensity of the current is equal to or larger than the preset first reference value $N\times I_{ref}$.

Specifically, the first resistor 431 senses a voltage applied to a current flowing in from the ground terminal 431-1 and the second resistor 432 and the third capacitor 433 removes noise included in the sensed voltage. The inverting unit 434 inverts the sensed voltage and outputs an inversion result to the first comparator 435.

The first comparator 435 determines whether or not the current flowing in from the ground terminal 431-1 reaches the first reference value $N\times I_{ref}$ and outputs a signal of a high state to the OR gate 439 when the current flowing in from the ground terminal 431-1 is equal to or larger than the first reference value $N\times I_{ref}$. Specifically, the first comparator 435 compares a voltage value applied to the first resistor 431 by the current flowing in from the ground terminal 431-1 with the first reference value $N\times I_{ref}$ and outputs the signal of a high state when the voltage value applied to the first resistor 431 reaches the first reference value $N\times I_{ref}$.

Here, the first reference value $N\times I_{ref}$ may be set to a value, that is, (an average value of a current which flows in the LED module 410 to obtain brightness of a user's desire)×2×(a resistance of the first resistor $R_{cs}$).

Meanwhile, in a state that the dimming signal is ON, since the first switch 437 turns on, the OR gate which receives the signal of a high state from the first comparator 435 outputs a signal of a high state, that is, a 'Fault' signal for stopping an operation of the LED driving unit 420. Thus, the external power is blocked so that the driving voltage is blocked to be applied to the LED module 410 by the LED driving unit 420.

That is, when a current which is larger than the average current to be flowed in the LED module 410 to obtain a brightness of a user's desire flows in the LED module 410, the LED driving control unit 430 determines that the LED module 410 is short-circuited with the exterior unit (not shown), causes the external power applied to the LED driving unit 420 to be blocked, and causes an operation of the LED driving unit 420 to be stopped.

Meanwhile, when the LED module 410 is short-circuited with the exterior unit (not shown) and a current flows from the LED module 410 to the exterior unit even in a state that the dimming signal is OFF, the LED driving apparatus according to the exemplary embodiment may sense the current flowing in the LED module 410 and causes the external power applied to the LED driving unit 420 to be blocked when the current flowing in the LED module 410 is equal to or larger than the third reference value V_short_ref.

Specifically, since the LED driving control unit 430 is connected to the ground terminal of the exterior unit (not shown), the LED output current flowing to the ground terminal of the exterior unit (not shown) through a wire is flowing in the LED driving control unit 430 as in an arrow direction.

Meanwhile, in a state that the dimming signal is OFF, the LED driving control unit 430 senses the intensity of the current flowing in through the ground terminal 431-1, causes the external power applied to the LED driving unit 420 to be blocked, and causes an operation of the LED driving unit 420 to be stopped when the sensed current is equal to or larger than the third reference value V_short_ref.

Specifically, the first resistor 431 senses a voltage applied by the current flowing in from the ground terminal 431-1, and the second resistor 432 and the third capacitor 433 removes noise from the sensed voltage. The inverting unit 434 inverts the sensed voltage and output the inversion result to the second comparator 436.

The second comparator 436 determines whether the current flowing in from the ground terminal 431-1 reaches the third reference value V_short_ref and outputs a signal of a high state to the OR gate 439 when the current flowing in from ground terminal 431-1 is equal to or larger than the third reference value V_short_ref. Specifically, the second comparator 436 compares a voltage value applied to the first resistor 431 by the current flowing in from the ground terminal 431-1 with the third reference value V_short_ref and outputs the signal of a high state when the voltage value applied to the first resistor 431 reaches the third reference value V_short_ref.

Here, the third reference value V_short_ref may be 0 V or a positive real number value close to 0V (for example, 0.5 V) in that the third reference value V_short_ref is set to cause a current not to flow in the LED module 410 in a state that the dimming signal is OFF.

Meanwhile, since the second switch 438 turns on in a state that the dimming signal is OFF, the OR gate which receives the signal of a high state from the second comparator 436 outputs a signal of a high state, that is, a 'Fault' signal for stopping an operation of the LED driving unit 420. Thus, since the external power is blocked and a driving voltage is interrupted to be applied to the LED module 410 by the LED driving unit 420, it is possible to control the current not to be flowed in the LED module 410 even when the LED module 410 is short-circuited with the exterior unit (not shown) and the dimming signal is OFF.

Figure 6:
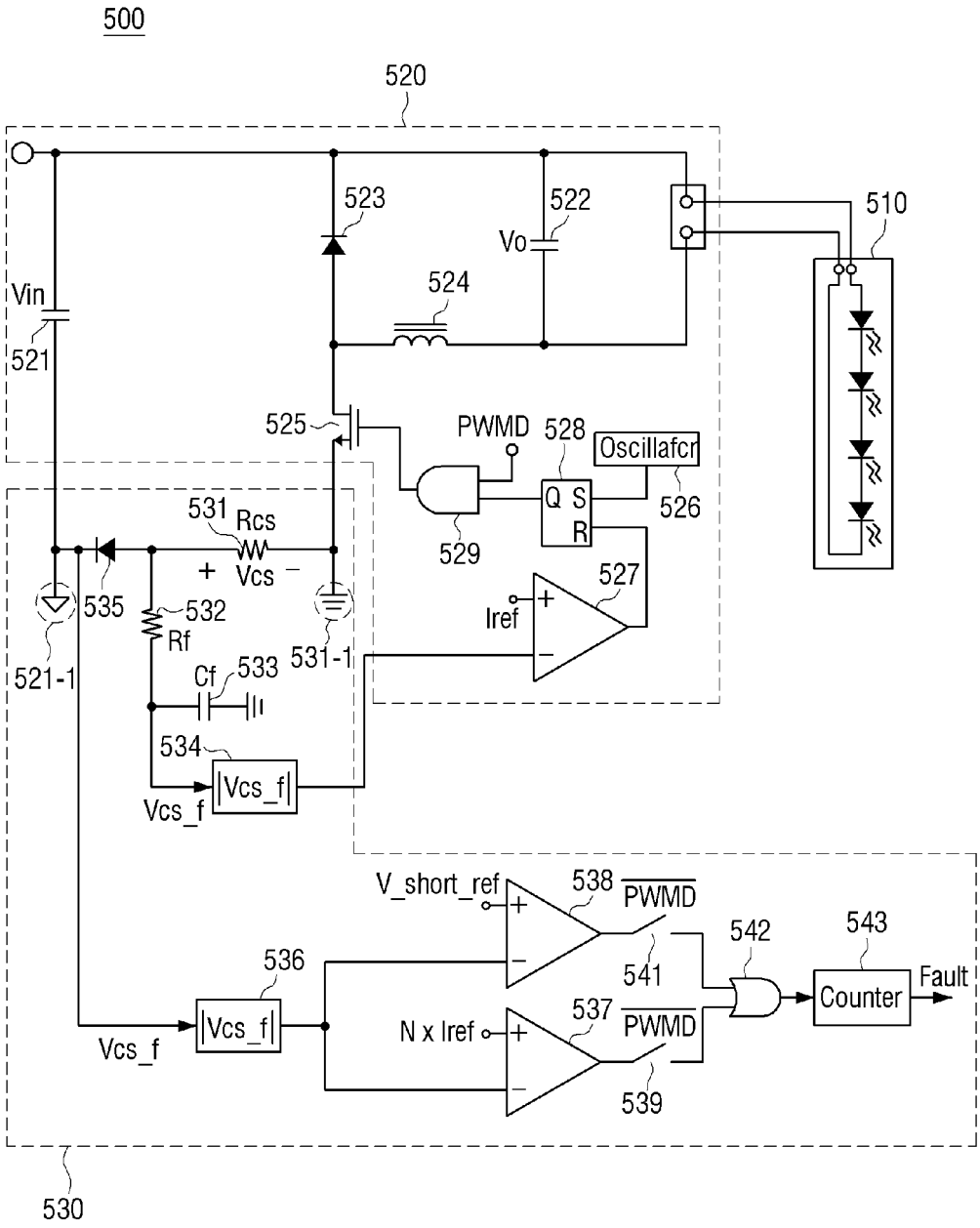
FIG. 6 is a circuit diagram illustrating a detailed configuration of an LED driving apparatus according to another exemplary embodiment.

FIG. 6 is a circuit diagram illustrating a detailed configuration of an LED driving apparatus according to another exemplary embodiment. In particular, the circuit diagram of FIG. 6 is different from the circuit of FIG. 4 only in that a diode is added.

As shown in FIG. 6, a second diode 535 of which an anode is commonly connected to the other terminal of a first resistor 531 and one terminal of a second resistor 532 and a cathode is commonly connected to an inverting unit 536 and a ground terminal of a first capacitor 521 (that is, a ground terminal of an external power) is further included. Thereby, it may be determined that an LED module 510 is short-circuited with an exterior unit (not shown) using a voltage value sensed by the first resistor 531 to be dull to noise.

An operation of the circuit of FIG. 6 is the same as that of the circuits of FIGS. 4 to 5B except for the second diode 535 and thus overlapping description will be omitted.

Figure 7:
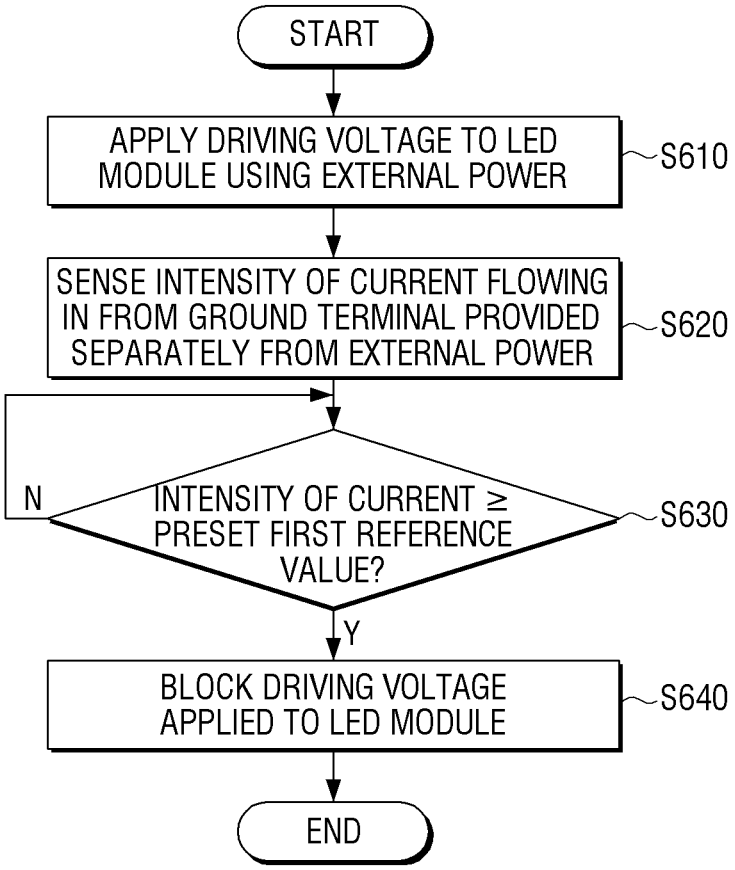
FIG. 7 is a flowchart illustrating an LED driving method of controlling an LED module according to an exemplary embodiment.

FIG. 7 is a flow chart illustrating an LED driving method of controlling an LED module according to an exemplary embodiment.

First, a driving voltage is applied to an LED module using an external power (operation S610).

Specifically, when an intensity of a current flowing in the LED module is smaller than a preset second reference value, a driving voltage may be applied to the LED module while an inductor is excited using a current flowing in from the external power and when the intensity of the current flowing in the LED module is equal to or larger than the second reference value, the driving voltage may be applied using a current induced by the excited inductor.

Hereafter, an intensity of a current flowing in from a ground terminal provided separately from the external power is sensed (operation S620)

In this case, it is determined whether or not the intensity of the current flowing in from the ground terminal is equal to or larger than a preset first reference value (operation S630) and the driving voltage applied to the LED module 410 is blocked (operation S640) when the intensity of the current flowing in from the ground terminal is equal to or larger than the preset first reference value (operation S630-Y).

Here, the first reference value may be larger than the second reference value. Specifically, the first reference value may be a value, that is (an average value of a current to be flowed in the LED module to obtain brightness of a user's desire)×N (here, N is a positive real number larger than 1) and the second reference value may be an average value of the current to be flowed in the LED module to obtain the brightness of a user's desire.

The foregoing exemplary embodiments and advantages are merely exemplary and are not to be construed as limiting the present application. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus, comprising:

a display panel which displays an image;

a light emitting diode (LED) module which provides backlight to the display panel;

an LED driving unit which receives a power from a power source and applies a driving voltage to the LED module;

a unit which comprises the LED driving unit and the LED module and further comprises a ground terminal which is separate spatially from the power source; and an LED driving control unit which senses a current flowing from the LED module to the unit using a current flowing from the ground terminal when the LED module is short-circuited with the unit and stops a receiving and applying operation of the LED driving unit based on the current flowing from the LED module to the unit.

2. The display apparatus as claimed in claim 1, wherein the LED driving control unit senses an intensity of a current flowing in the LED module and transmits a result of the sensing to the LED driving unit; and senses the intensity of the current flowing from the ground terminal, thereby stopping the operation of the LED driving unit when the intensity of the current flowing from the ground terminal is equal to or larger than a first reference value.

3. The display apparatus as claimed in claim 2, wherein the LED driving unit applies the driving voltage to the LED module while exciting an inductor using the current flowing from the power source when the intensity of the current flowing in the LED module is smaller than a second reference value and applies the driving voltage to the LED module using a current induced by the excited inductor when the intensity of the current flowing in the LED module is equal to or larger than the second reference value, wherein the first reference value is larger than the second reference value.

4. The display apparatus as claimed in claim 3, wherein the LED driving unit comprises:

a first capacitor connected in parallel to the power source;

a second capacitor connected in parallel to the LED module;

a first diode of which a cathode is commonly connected to a first terminal of the first capacitor, a first terminal of the second capacitor, and an anode of the LED module;

the inductor of which a first terminal of the inductor is connected to an anode of the first diode and a second terminal of the inductor is commonly connected to a second terminal of the second capacitor and a cathode of the LED module; and a transistor of which a drain of the transistor is commonly connected to the first terminal of the inductor and the anode of the first diode and a source of the transistor is connected to the ground terminal.

5. The display apparatus as claimed in claim 4, wherein the LED driving control unit senses the intensity of the current flowing in the LED module and the intensity of the current flowing from the ground terminal using a current flowing in a resistor of which a first end of the resistor is connected to the ground terminal and a second end of the resistor is connected to the second terminal of the first capacitor.

6. The display apparatus as claimed in claim 5, wherein the LED driving control unit further comprises a first comparator which compares the intensity of the current flowing from the ground terminal with the first reference value.

7. The display apparatus as claimed in claim 6, wherein the LED driving control unit further comprises:

a second comparator which compares the intensity of the current flowing from the ground terminal with a third reference value; and an OR gate which performs a logic OR operation on a comparison result of the first comparator and a comparison result of the second comparator and outputs a logic OR operation result, wherein the first reference value is larger than the third reference value.

8. The display apparatus as claimed in claim 5, wherein the LED driving unit further comprises:

an oscillator which generates a clock signal for periodically driving the transistor;

a third comparator which compares the intensity of the current flowing in the LED module with the second reference value;

an RS flip flop which receives a comparison result of the third comparator as a reset signal and an output signal of the oscillator as a set signal; and an AND gate which performs a logic AND operation on a dimming signal and an output signal of the RS flip flop and applies a result of the logic AND operation to a gate of the transistor.

9. A light emitting diode (LED) driving apparatus which controls an LED module, the apparatus comprising:

an LED driving unit which receives a power from a power source and applies a driving voltage to the LED module;

a unit which comprises the LED driving unit and the LED module and further comprises a ground terminal which is separate spatially from the power source; and an LED driving control unit which senses a current flowing from the LED module to the unit using a current flowing from the ground terminal when the LED module is short-circuited with the unit and stops a receiving and applying operation of the LED driving unit based on the current flowing from the LED module to the unit.

10. The apparatus as claimed in claim 9, wherein the LED driving control unit senses an intensity of a current flowing in the LED module and transmits a result of the sensing to the LED driving unit; and senses the intensity of the current flowing from the ground terminal, thereby stopping the operation of the LED driving unit when the intensity of the current is equal to or larger than a first reference value.

11. The apparatus as claimed in claim 10, wherein the LED driving unit applies the driving voltage to the LED module while exciting an inductor using a current flowing from the power source when the intensity of the current flowing in the LED module is smaller than a second reference value and applies the driving voltage to the LED module using a current induced by the excited inductor when the intensity of the current flowing in the LED module is equal to or larger than the second reference value, wherein the first reference value is larger than the second reference value.

12. The apparatus as claimed in claim 11, wherein the LED driving unit comprises:

a first capacitor connected in parallel to the power source;

a second capacitor connected in parallel to the LED module;

a first diode of which a cathode is commonly connected to a first terminal of the first capacitor, a first terminal of the second capacitor, and an anode of the LED module;

the inductor of which a first terminal of the inductor is connected to an anode of the first diode and a second terminal of the inductor is commonly connected to a second terminal of the second capacitor and a cathode of the LED module; and a transistor of which a drain of the transistor is commonly connected to the first terminal of the inductor and the anode of the first diode and a source of the transistor is connected to the ground terminal.

13. The apparatus as claimed in claim 12, wherein the LED driving control unit senses the intensity of the current flowing in the LED module and the intensity of the current flowing from the ground terminal using a resistor of which a first terminal of the resistor is connected to the ground terminal and a second terminal of the resistor is connected to a ground terminal of the power source.

14. The apparatus as claimed in claim 13, wherein the LED driving control unit further comprises a first comparator which compares the intensity of the current flowing from the ground terminal with the first reference value.

15. The apparatus as claimed in claim 14, wherein the LED driving control unit further comprises:

a second comparator which compares the intensity of the current flowing from the ground terminal with a third reference value; and an OR gate which performs a logic OR operation on a comparison result of the first comparator and a comparison result of the second comparator and output a logic OR operation result, wherein the first reference value is larger than the third reference value.

16. The apparatus as claimed in claim 13, wherein the LED driving unit further includes:

an oscillator which generates a clock signal for periodically driving the transistor;

a third comparator which compares the intensity of the current flowing in the LED module with the second reference value;

an RS flip flop which receives a comparison result of the third comparator as a reset signal and an output signal of the oscillator as a set signal; and an AND gate which performs a logic AND operation on a dimming signal and an output signal of the RS flip flop and apply a logic AND operation result to a gate of the transistor.

* * * * *